US005979888A

United States Patent [19]

Schlough

[11] Patent Number: 5,979,888

[45] Date of Patent: Nov. 9, 1999

[54] LAPPED STREAM FEEDING ADAPTION FOR SHEET MATERIAL ARTICLES

[75] Inventor: James R. Schlough, Troy, Ohio

[73] Assignee: Heidelberger Druckmaschinen AG, Heidelberg, Germany

[21] Appl. No.: 09/070,098

[22] Filed: Apr. 27, 1998

[51] Int. Cl.[6] ..... B65H 39/05; B65H 39/055; B65H 39/065; B65H 33/04; B65H 39/02; B65H 39/07; B65H 39/075; B65H 39/045; B65H 39/04; B42B 2/00; B42B 3/02

[52] U.S. Cl. ..... 270/58.21; 270/58.29; 270/58.3; 270/52.01; 270/52.03

[58] Field of Search ..... 270/55, 52.14, 270/52.16, 52.03, 58.01, 58.2, 58.21, 58.29, 58.3, 58.03, 58.24; 198/367.1, 369.1, 370.01, 418.3, 418.4, 418.9

[56] References Cited

U.S. PATENT DOCUMENTS 3,313,221 4/1967 Gubeli ..... 93/93 X
4,901,995 2/1990 Kempisty ..... 270/54 X
4,988,086 1/1991 Schlough .
5,031,891 7/1991 Kobler et al. .
5,213,318 5/1993 Newhall ..... 270/55

*Primary Examiner*—William E. Terrell
*Assistant Examiner*—K W Bower
*Attorney, Agent, or Firm*—Tarolli, Sundheim, Covell, Tummino & Szabo LLP

[57] ABSTRACT

Sheet-like material articles are gathered in gathering pockets which move along a path in a horizontal direction. The sheet-like material articles are conveyed in a shingled stream adjacent the path. On each of the gathering pockets a deflector is actuatably arranged. The deflector intercepts the leading edge of a respective sheet-like material article while in the shingled stream. The sheet-like material article is deflected into a gathering pocket.

19 Claims, 5 Drawing Sheets

LAPPED STREAM FEEDING ADAPTION FOR SHEET MATERIAL ARTICLES

FIELD OF THE INVENTION

The present invention is related to a lapped stream feeding device for a gathering and collating device which is used for forming assemblages of sheet-like material articles and the like.

BACKGROUND OF THE INVENTION

U.S. Pat. No. 5,031,891 discloses a method and system for selectively collating different printed products, particularly different newspaper inserts for targeted distribution. To permit placement of selected products having different subject matter together in specifically collated product assemblies, for association of individualized product assemblies with delivery addresses in a specific sequence, for example specific to subscribers or distribution stations or regions, a controller-computer stores delivery addresses. All the products are stored in individual storage locations, from which, with respect to a specific address within the sequence, selected individual products are removed, for placement on collecting spaces on a collecting transport system.

The controller-computer includes timing circuits controlling, respectively the removal and guidance of selected products for the specific addresses in the sequence to specific collecting spaces, as the transport system moves beneath the storage locations or stations, to form the collected product assemblies which, then, can be supplied with a cover or directly with the delivery address. The first or last of the product stations can hold folded newspapers which, for example, can be the main section of a newspaper with which specific regional or advertisement inserts, formed by the products, are then assembled.

U.S. Pat. No. 4,988,086 discloses an apparatus and method for forming sheet material assemblages. The apparatus for forming sheet material assemblages includes a plurality of sheet material assemblers which travel in a continuous path and sequentially pass beneath stacks of sheet material. The stacks of sheet material are disposed in bottomless hoppers. The sheet material assemblers include belts which support the stacks of sheet material in the bottomless hoppers. The belts move with the sheet material assemblers to sequentially engage the stacks of sheet material. Upper runs of the belts move in opposite directions to the sheet material assemblers and at the same speed as the sheet material assemblers so that the upper runs of the belts are stationary relative to the stacks of sheet material. The sheet material assemblers also include feed mechanisms and receiving locations. As a sheet material assembler passes under a stack (pile) of sheet material, sheet material is fed from the stack of sheet material by a feed mechanism to a receiving location.

SUMMARY OF THE INVENTION

It has been found that placing of sheet-like material articles in stacks or piles does not permit processing steps such as selectively ink jetting of the sheet-like material articles to be executed prior to the feeding of the sheet material articles from the stack or pile to the receiving locations. Furthermore, odd products are difficult to remove from a stack or pile. Also, a stack or pile does not favor the feeding of the sheet-like material articles from a source such as a print roll which delivers sheet-like material articles in a lapped stream. Still further it is a disadvantage of bulk stacking or piling that the next sheet-like material article to be fed might have to wait for a thousand cycles to be selected which can result in marking or degrading of the respective sheet-like material article at the bottom of the bulk stack or pile.

It is an object of the present invention to allow for continuous feeding of sheet-like material articles to a gathering system which provides for rapid access to the conveyed sheet-like material articles.

A further object of the present invention is to provide for a deliberate interception of each leading edge of the fed sheet-like material articles.

According to the present invention a gathering system for sheet-like material articles comprises:

- gathering pockets moving along a path in horizontal direction,
- a conveyor for moving sheet-like material articles in a shingled formation adjacent the path,
- a deflector actuatably arranged on the gatherer pockets, the deflector is movable to intercept the leading edges of sheet-like material articles.

The solution according to the present invention has numerous advantages. Since the sheet-like material articles are being fed in an overlapping manner, a good portion of the lapped distance can be used as a time period within which the deflectors can adopt their activated position before intercepting a respective lead edge portion of a sheet-like material article to be fed to a predetermined gathering pocket. The lapped distance permits the respective deflectors to stay in an activated position for a sufficient period of time within which the lead edge portion of the intercepted product has been deflected sufficiently into the respective gathering pocket.

According to further details of the solution according to the present invention feeding stations are arranged at different locations along the path of the gathering pockets, allowing for sequential feeding of sheet-like material articles, to individual gathering pockets. The feeding stations may comprise a section extending parallel to the direction of travel of the gathering pockets, thus covering the infeed areas of a number of gathering pockets simultaneously. The section can convey sheet-like material articles opposite to the direction of travel of the respective gathering products and provides a plurality of sheet-like material articles within the conveying plane above the gathering pockets. The conveying plane is formed between the section of the infeed stations extending parallel to the feed direction of the gathering pockets and a respective surface of each gathering pocket.

The gathering pocket surfaces are surfaces of belts moving in a direction opposite the travel direction of the gathering pockets. Furthermore, the gathering pockets each comprise a deflector movable into the conveying plane between the section of the infeed station and the surface of the respective gathering pocket. The deflectors, either a blade or a roller shaped element, are arranged on actuating elements such as shafts or slidably mounted supports to allow for movement thereof relative to the gathering pockets.

In one embodiment the deflector may be mounted on an actuating shaft, adopting a disengaged or engaged position, respectively. In its disengaged position, the deflector according to an embodiment of the invention closes a gap of a gathering pocket allowing the sheet-like material article to travel along the conveying plane. When in the engaged position, i.e. intercepting the conveying plane, the respective lead edge of a sheet-like material article is deviated into a respective entry section of a gathering pocket. Another embodiment of the present invention allows for slidable movement of a deflector on a support which may be actuated by a modified actuating shaft, either driven by a separate drive or by a cam arrangement. In a further embodiment of the present invention the deflector is a roller shaped element which upon contact with revolving belts on top of a gathering pocket forms a nip. After the lead edge portion of a sheet-like material article has been seized within the nip, the roller shaped deflector moves in a direction to allow for a sufficient entry of the respective lead edge portion of the sheet-like material article into the gap of an entry section of a gathering pocket.

The feeding station arranged along the travel path of the gathering system feeds a shingled formation of sheet-like material articles between a feeding belt section and a corresponding counter belt assembly. At the bottom of feeding belt section and counter belt assembly a release portion is formed through which the sheet-like material articles move into the respective previously mentioned conveying plane.

According to the present invention a method for gathering sheet-like material articles includes the steps of:

feeding sheet-like material articles in a shingled formation in a conveying plane, the conveying plane for the sheet-like material articles extending parallel to the conveying direction of gathering pockets, moving deflectors selectively into the conveying plane, and deflecting the lead edge portion of the sheet-like material articles into a respective gathering pocket.

A further step according to this method can include the deflector's movement into the conveying plane before intercepting a respective lead edge portion due to the lapped distance between the sheet-like articles within the conveyed shingled formation.

BRIEF DESCRIPTION OF THE DRAWINGS

Although the novel features which are believed to be characteristic of this invention will be pointed out with particularity in the appended claims, the manner of its organization and the mode of its operation will be understood by referring to the following description, read in conjunction with the accompanying drawings forming a part hereof, in which:

DESCRIPTION OF PREFERRED EMBODIMENTS

Figure 1:
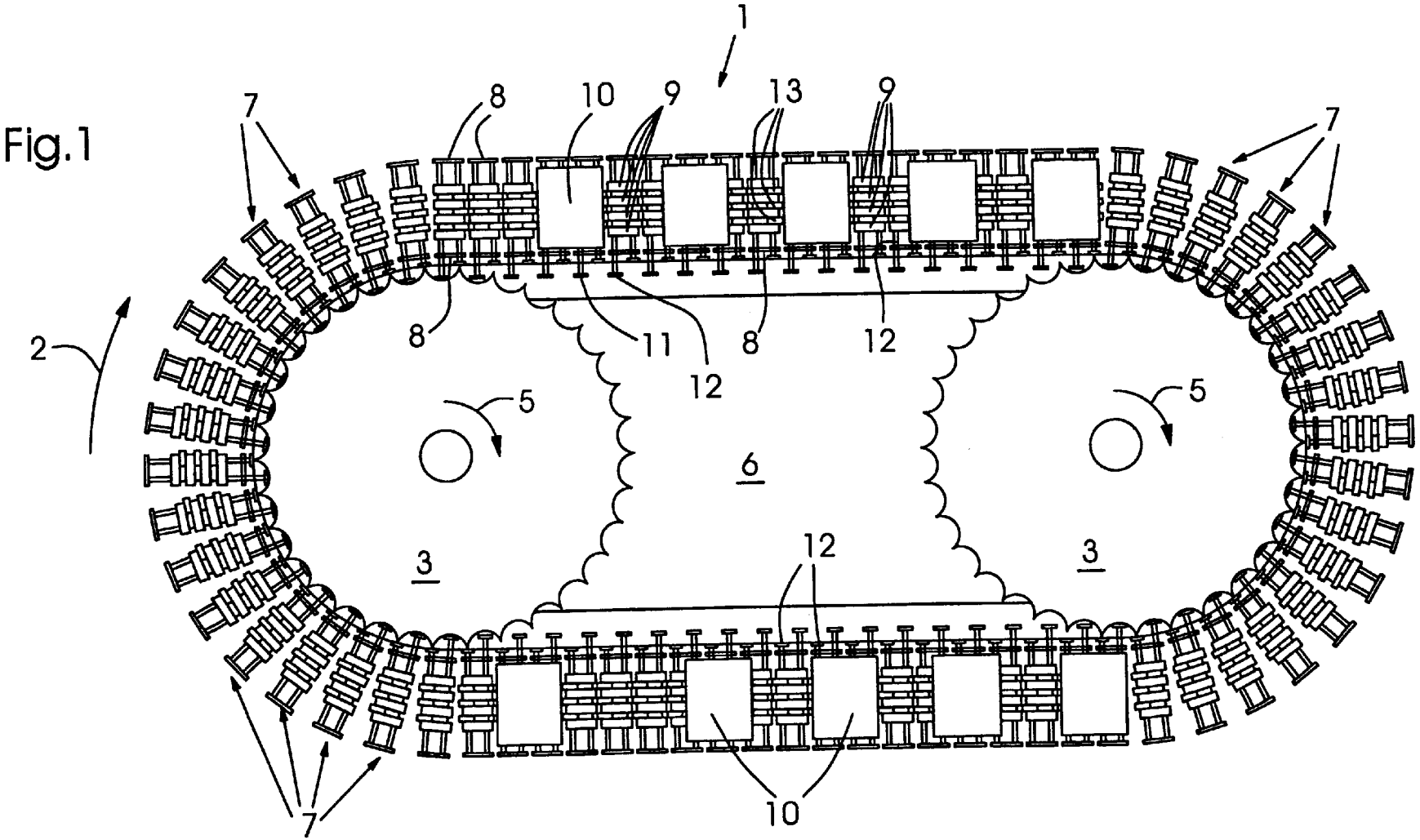
FIG. 1 shows a gathering system comprising various gathering pockets moveably arranged along a conveying path.

FIG. 1 shows a gathering system 1 comprising various gathering pockets 7 moveably arranged on a conveying path.

According to FIG. 1 the gathering system 1 comprises a plurality of gathering pockets 7, moving along a conveying path in a direction of travel 2. The various gathering pockets 7, for example arranged in an endless loop, travel around sprocket wheels 3 of the gathering system 1, mounted on a central frame 6. At infeed stations 10 arranged at various locations along the path sheet-like material articles 4 are fed in a selective manner to the various gathering pockets 7. The gathering pockets 7 each comprise pocket frames 8. In the pocket frames 8 a belt drive shaft 11 and an actuating shaft 12 are arranged. The belt drive shaft 11 substantially drives a plurality of belts 9 in a direction opposite to the direction of movement of the gathering pockets 7 along their path such that the upper surface of the belts 9 are essentially motionless, as disclosed in U.S. Pat. No. 4,998,086.

On the actuating shaft 12 between the pocket frames 8 of the gathering pockets 7, pulleys 21 for the belts 9 and deflector means 13 are mounted. The deflector means only schematically shown in FIG. 1 may adopt an engaged position 13.2 and a disengaged position 13.1, as can be seen in FIG. 2.

Figure 2:
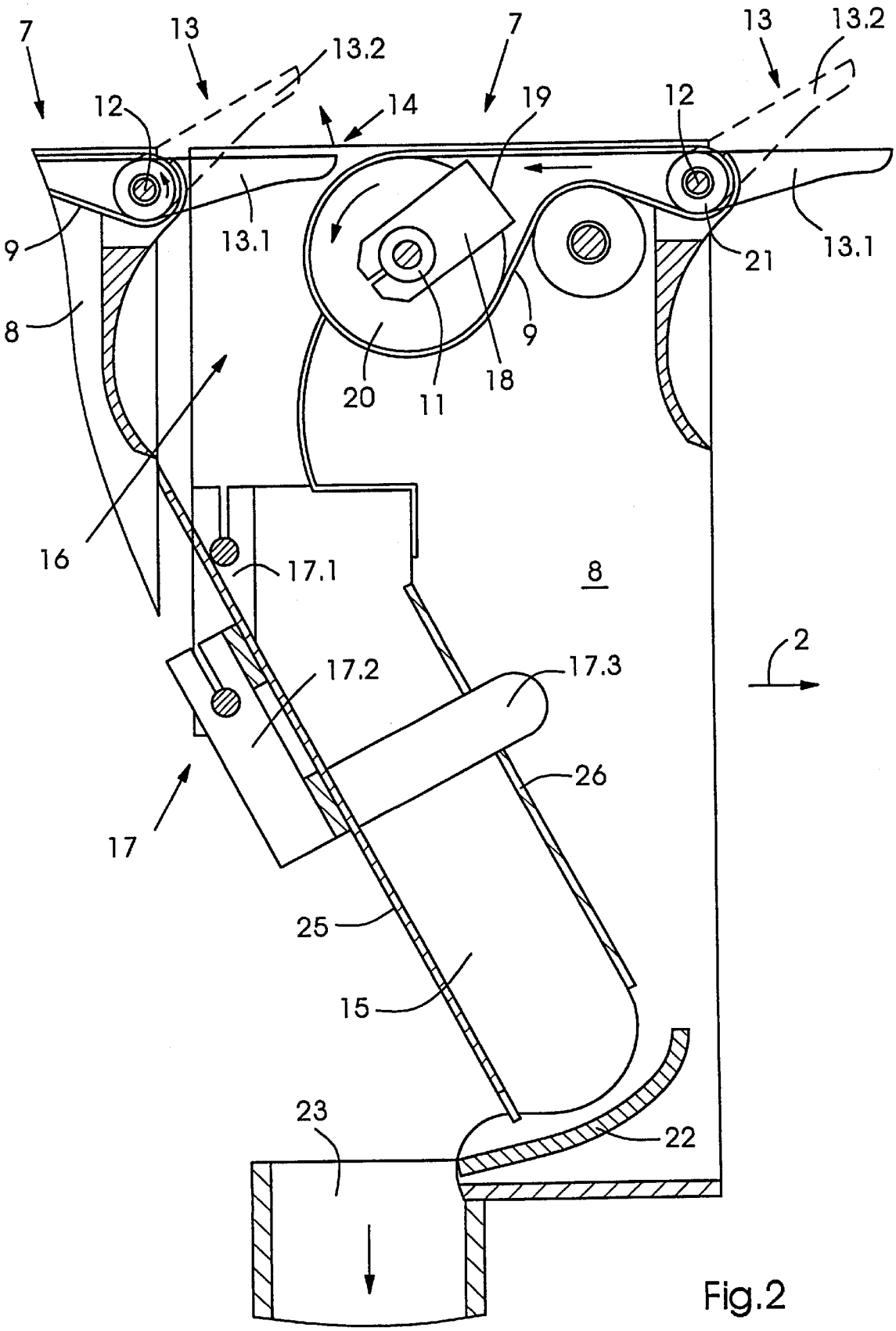
FIG. 2 shows a side elevation of a gathering pocket having a deflector shown in an engaged and a disengaged position.

FIG. 2 represents a side elevation of a gathering pocket having a deflector shown in solid lines in the disengaged position and in dotted lines in the engaged position, respectively.

In FIG. 2 a gathering pocket 7 is shown in greater detail.

The gathering pockets 7 each include the pocket frames 8 supporting between each a belt drive shaft 11 and an actuating shaft 12. In the upper portion of the gathering pockets 7, revolving belts 9 are arranged and are driven opposite the direction of travel 2 of the gathering pockets 7. The belts 9 are driven via a belt drive shaft 11 on which a pulley 20 is mounted, and are tensioned via a tensioning roller and further revolve about a pulley 21 arranged on an actuating shaft 12. In FIG. 2 a deflector 13 of a gathering pocket 7 which follows another gathering pocket 7 is shown in greater detail. The deflector 13, for example, is mounted on an actuating shaft 12, which is coupled to a drive or is rotatable via a cam arrangement. In its disengaged position 13.1 the deflector 13 closes a gap 14 in the gathering pocket 7 to let the sheet-like material articles 4 being conveyed pass along to another gathering pocket 7. In its engaged position 13.2, the deflector projects into a conveying plane for the sheet-like material articles.

Below an entry section 13 of a respective gathering pocket 7 a gathering section 15 is arranged, consisting of two wall members 25, 26 respectively. Both wall members 25, 26 respectively are linked with each other via a linkage 17.3, which forms one part of an actuating assembly 17. Further parts of the actuating assembly 17 are a first and a second lever 17.1, 17.2 respectively, which swing the gathering section 15 from a location above a bottom 22 of the gathering pocket (FIG. 2) to a release position as shown in FIG. 3.

On the belt drive shaft 11 is mounted a pulley 20 for driving the belts 9. A suction device 18 is also mounted on the shaft 11 and has a sucker face 19 oriented toward the conveying plane. This sucking device 18 assists the deflector 13 in deflecting the sheet-like material articles into the pocket 7, particularly if sheet-like material articles are of a larger thickness or cardboard stock may have to be fed to the entry section 16 of a gathering pocket 7.

Figure 3:
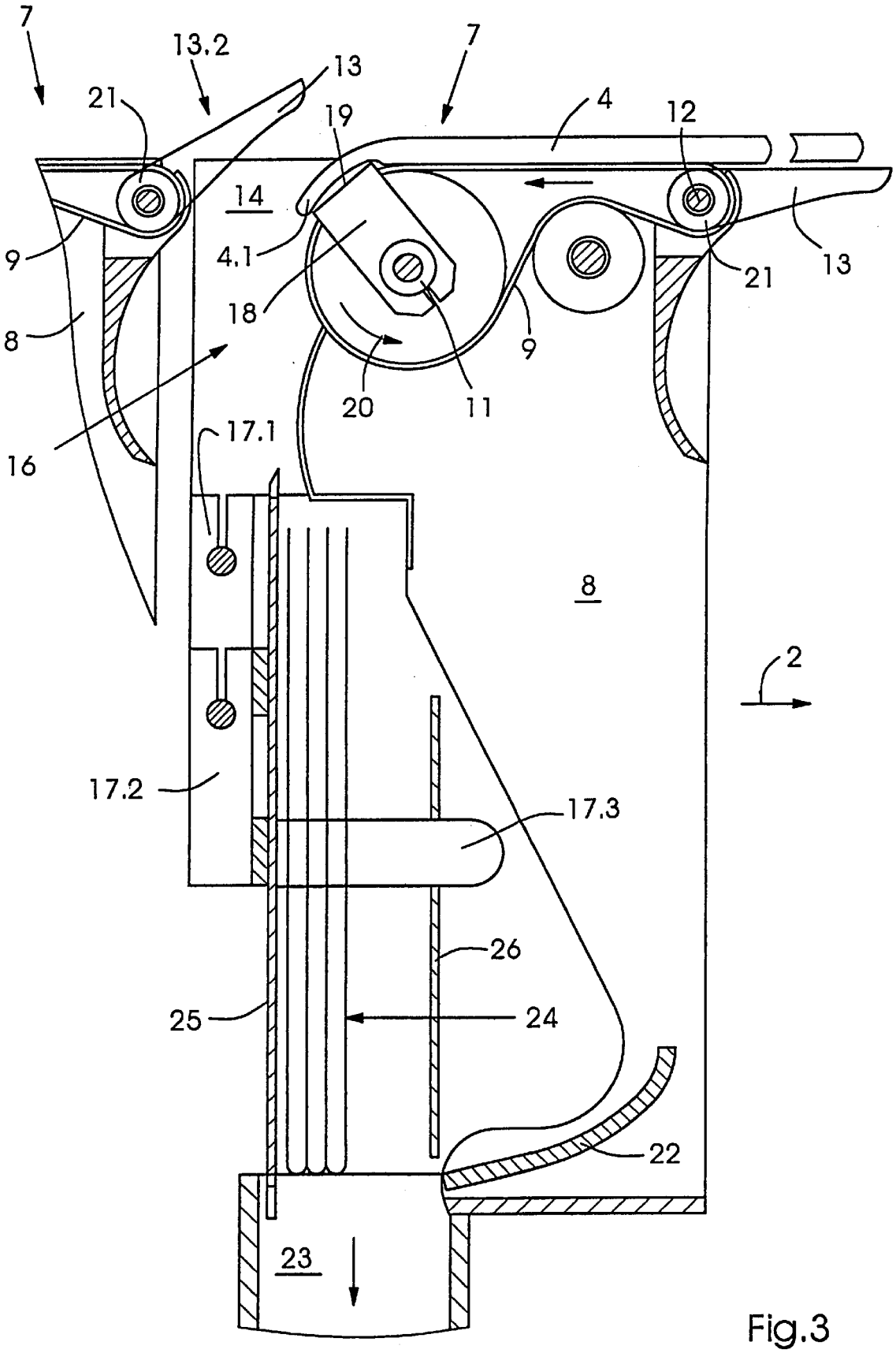
FIG. 3 shows a side elevation of a gathering pocket, the sheet-like material articles in the pocket being ready for a transfer from the pocket for further processing thereof.

In FIG. 3 a side elevation of a gathering pocket 7 is shown, a previously gathered sheet material assembly being ready for transfer from the gathering pocket.

In FIG. 3, the gathering section 15 has been moved by the actuating assembly 17 into a release position, from which a previously gathered assembly 24 will be passed from the gathering section 15 via outlet 23 for further processing. At the same time, a leading edge portion 4.1 of a sheet-like material article 4 is lead into the gap 14 to enter the gathering pocket 7. The deflector 13 attached to a following gathering pocket 7 is in its engaged deflecting position 13.2, i.e. is projecting into the conveying plane intercepting the sheet material articles in the conveying plane. Additionally, a vacuum can be applied to assist the deflection of the sheet material articles 4 leading edge portion 4.1, i.e. the sucker face 19 of the sucker 18 then engages leading edge 4.1 and deflects the leading edge of a sheet-like material article into the gap 14. The use of the sucker 18 may only apply to thicker sheet material articles 4 and is not necessarily required when processing regular stock.

The deflector 13 in its engaged position 13.2 as shown in FIG. 3 can be moved into its disengaged position 13.1 well before it intercepts the leading edge 4.1 of the next sheet material article 4. This can be achieved since the sheet material articles 4 are fed leading edge 4.1 up on the respective next product 4 conveyed. Thus, the lapped distance within the incoming stream of sheet material articles can be used as a "window". The deflector 13 remains in its engaged position 13.2 for a sufficient period of time within which the respective lead edges 4.1 have been deflected sufficiently into said gap 14.

Figure 4:
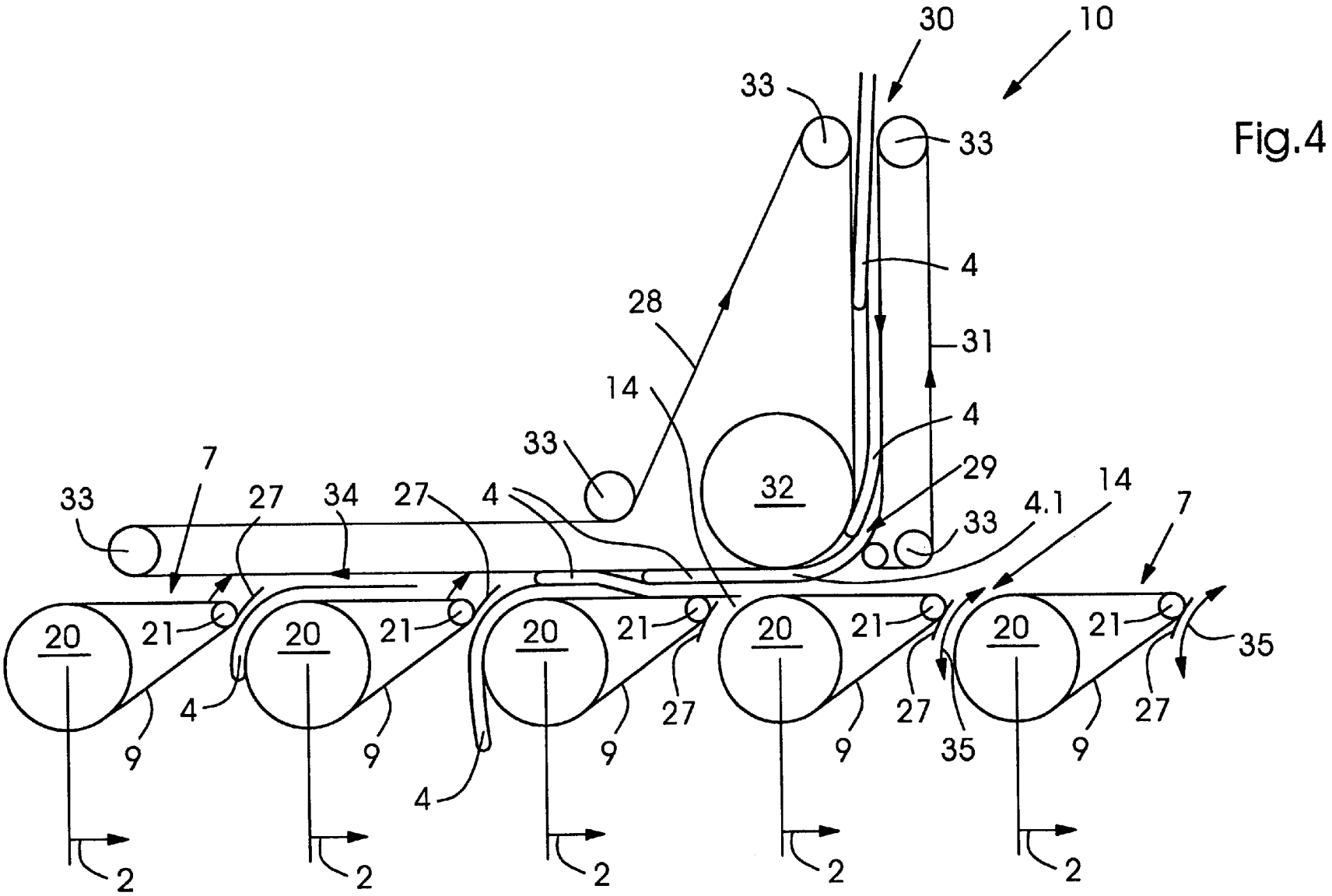
FIG. 4 shows a feeding station for feeding sheet-like material articles in a shingled formation, and a deflector which is slidably movable.

In FIG. 4 a feeding station 10 for feeding sheet-like material articles in a shingled formation is shown with deflectors which have a sliding movement as indicated by the arrows 27.

According to this embodiment the feeding station 10 includes a feeding belt section 28 which has a portion which extends parallel to and is adjacent the respective upper runs of belts 9 of the gatherer pockets 7. The portion of belt section 28 which is parallel to and adjacent the upper runs of belts 9 travels opposite to the direction of travel 2 of the various gathering pockets 7, thus enabling a number of sheet-like material articles 4 to be within the conveying plane above the surfaces 9 of the gatherer pocket 7. A shingled formation 30 of sheet-like material articles is fed vertically to the feeding station 10 and is seized between the feeding belt section 28 and a corresponding counter belt assembly 31. The belts rotate about pulleys 32, 33 respectively, to convey the sheet-like material articles 4 to a release portion 29 between the feeding belt section 28 and the counter belt assembly 31. Upon emerging from the release portion 29 the sheet-like material articles are deflected by a deflector roller 32 of a relatively large diameter into the conveying plane, defined between the longitudinally extending feeding belt 28 and the respective surfaces 9, i.e. the upper run of driven belts 9 of the gathering pocket 7. At this location in the conveying plane the orientation of the lead edge portion 4.1 is such that each lead edge 4.1 is arranged above the preceding sheet-like article 4.

The deflector in this embodiment is a blade-shaped element 27, the tip of which upon a sliding movement as indicated by arrow 35 moves into (intercepts) the conveying plane of the sheet-like material article 4. The deflector 27 is mounted in the vicinity of the pulley 21 of the gathering pockets 7. Its actuation is achieved by a sliding movement of a support. The sliding movement may either be imposed by a drive or a cam arrangement, not shown in greater detail. In the stage given in FIG. 4, the deflectors 27 of two gathering pockets 7 are activated, i.e. intercepting the conveying plane of the sheet-like articles 4 and are directing a portion of the sheet material articles 4 into the interior of the respective gathering pocket 7.

A sheet-like material article 4 is almost completely entered into a respective gathering section 15 of the center gathering pocket 7 shown in FIG. 4. Only the upper portion of the gathering pockets 7 are shown in FIG. 4, including the belts 9 rotating about pulleys 20, 21, respectively, and the deflector 27 arranged on the front ends of the respective gathering pockets 7.

The shingled formation 30 emerging from the release portion 29 is conveyed into direction 34 as indicated by the arrow assigned to the feeding belt section 28. The conveying speed of the shingled formation 30 is different than the speed of the belts 9 of the individual gathering pocket 7.

Figure 5:
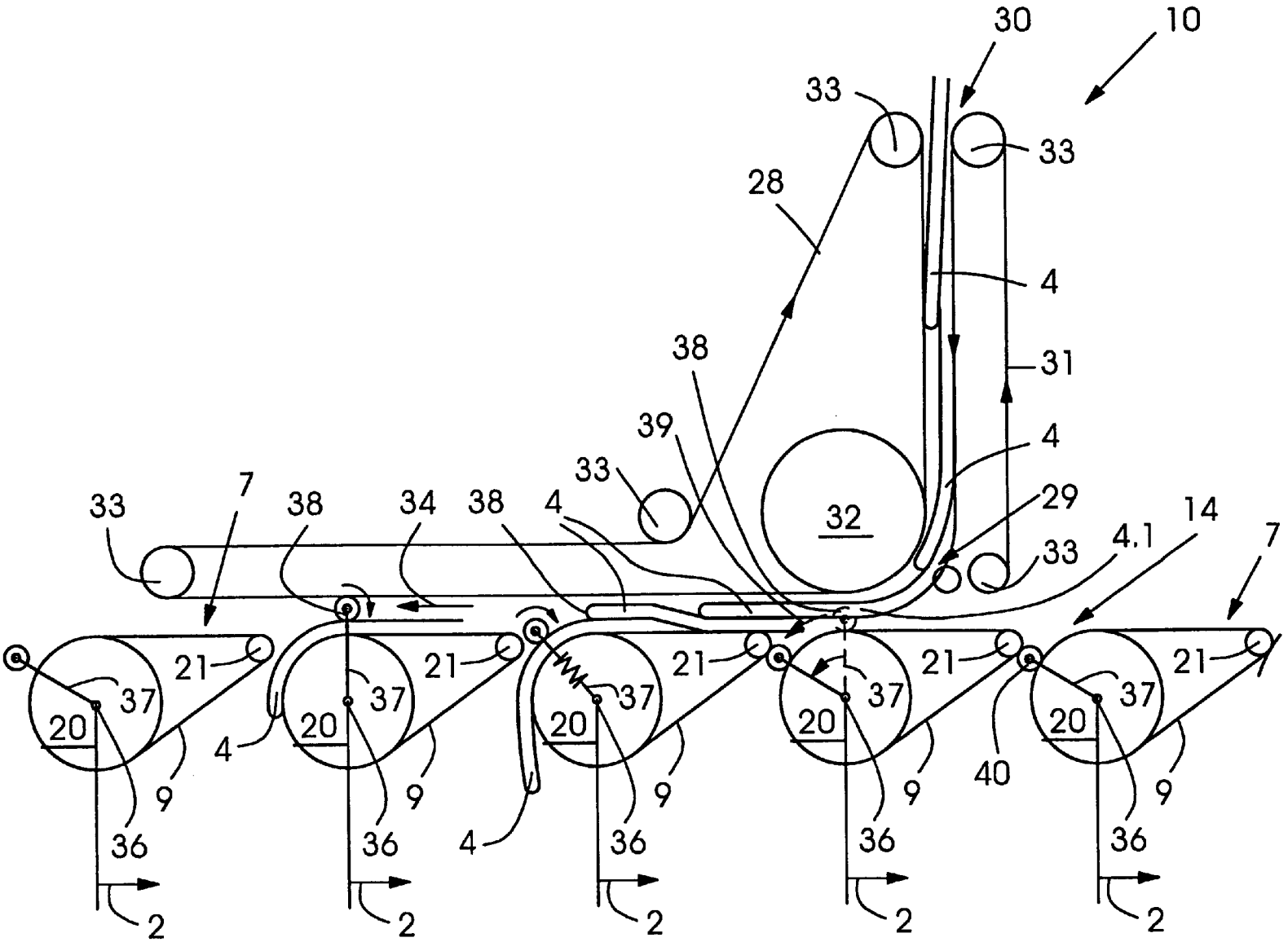
FIG. 5 shows a feeding station feeding sheet material articles in a shingled formation, and a deflector including a roller moveable in a planetary fashion around the center of a pulley.

Another embodiment is shown in FIG. 5, having a roller-shaped deflector moving in planetary fashion around a center.

In the embodiment of FIG. 5 the feeding station 10 does not differ substantially from the feeding station 10 of FIG. 4. Instead of having a deflector 13 or 27 either being pivotally or slidably mounted, a roller deflector element 38 is attached to a lever 37 and is rotatable relative to the lever 37 about the axis of the roller deflector element 38. The lever 37 moves about a center 36 of a belt pulley 20 in a counterclockwise direction as viewed in FIG. 5. The deflector 38 can move from a position in engagement with the belt drive pulley 20 such as shown for the gathering pocket on the far right of FIG. 5 to the dotted line position on top of pulley 20 as shown for the gathering pocket which is next to the gathering pocket on the far right in FIG. 5. In its position on top of the pulley 20 the deflector 38 creates a nip between the belt 9 and the surface of the deflector 38. A lead edge portion 41 will be conveyed into the nip, and the roller deflector 38 may move radially outward of the center 36 of pulley 20. Upon rotational movement of the deflector 38 around center 36 in a counterclockwise direction the deflector 38 revolves on said belts 9, thus deflecting the respective lead edge portion 4.1 into the gap 14 of the respective gathering pocket 7. The pivotable lever 37 moves the deflector 38 in a counterclockwise direction (as viewed in FIG. 5) around the pulley 20, thus moving the sheet material article 4 into the respective gathering pocket 7. The roller-shaped deflector 38 is not rotated about its axis by any separate drive, its rotation about its own axis is created by contacting the belt 9 driven by the belt drive shaft 11.

In the embodiment of FIG. 5 the previously mentioned actuating shaft 12 is modified such that a movement of lever 37 around the center 36 of pulley 20 is provided independently from the belt drive shaft 11 assigned to the pulley 20 and its belts 9. The pitch between subsequent gathering pockets 7 and the diameter of the deflector 38 is chosen such that upon an approximately 45° of movement of the deflector about axis 36 no interference with subsequent gathering pockets 7 occurs.

According to the embodiment of the present invention utilizing the various deflectors 13, 27, and 38 the distance between the lapped portions of sheet-like material articles 4 offers a functional window within which the deflection of lead edge portions of the sheet-like material articles is feasible without interfering in the conveyance of the shingled formation. Also, the lapped stream increases productivity since the infeed speeds are high, and frequent stop-and-go operation is avoided.

Having described the invention, what is now claimed is:

1. A gathering system for sheet-like material articles comprising:

gathering pockets (7) movable along a path in a horizontal direction (2), a conveyor (10) for moving sheet-like material articles in a shingled formation adjacent said path, a deflector (13, 27, 38) actuatably arranged on each of said gathering pockets (7), said deflector (13, 27, 38) being movable to intercept a sheet material article's (4) respective leading edge (4.1) as the sheet-like material article moves in said shingled formation and for deflecting the respective leading edge into a gathering pocket.

2. A gathering system according to claim 1 wherein plural conveyors (10) are arranged at different locations along the path of said gathering pockets (7).

3. A gathering system according to claim 1 wherein a deflector (27) slidably moves into the conveying plane defined between said section and the surface of said gathering pockets (7).

4. A gathering system according to claim 1 wherein a deflector (38) rotatingly moves into the conveying plane between said section and the surface of said gathering pockets (7).

5. A gathering system according to claim 4 wherein said deflector (38) contacts the surface of the belts (9) of said gathering pockets (7), forming a nip.

6. A gathering system according to claim 4 wherein said deflector (38) moves around a center (36) of a belt pulley (20).

7. A gathering system according to claim 4 wherein said deflector (38) is mounted to a pivotal lever (37).

8. A gathering system according to claim 1 wherein said conveyor (10) includes a feeding belt section (28) cooperating with a counter surface (31).

9. A gathering system according to claim 8, wherein said shingled formation (30) of sheet-like material articles (4) is conveyed between the feeding belt section (28) and the counter surface (31).

10. A gathering system according to claim 8 wherein a release portion (29) for said sheet-like material articles (4) extends into the conveying plane between the section (28) and the surface (9) of said gathering pockets (7).

11. A gathering system according to claim 1 wherein said conveyor (10) comprises a section extending parallel to the direction (2) of travel of said gathering pockets (7).

12. A gathering system according to claim 11 wherein said section of the conveyor (10) travels in a direction opposite the direction of travel of said gathering pockets (7).

13. A gathering system according to claim 11 wherein a conveying plane is formed between said section extending parallel to the direction of movement of the gathering pocket (7) and a respective surface thereof.

14. A gathering system according to claim 13 wherein said surface is a surface of a belt moving in an opposite direction with respect to the travel direction (2) of said gathering pockets (7).

15. A gathering system according to claim 11 wherein said deflector (13, 27, 28) is movable into the conveying plane between said section and the surface of the respective gathering pocket (7).

16. A gathering system according to claim 15 wherein said deflector (13) is mounted on an actuating shaft (12), said deflector adopting a disengaged and engaged position (13.1, 13.2), respectively.

17. A gathering system according to claim 16 wherein said deflector (13) in its disengaged position (13.1) covers a gap (14) on said gathering pockets (7) closing an entry section (16) thereof.

18. A method for gathering sheet-like material articles including the steps of:

moving gathering pockets (8) along a path in a horizontal direction (2);

conveying sheet-like material articles (4) in a shingled formation (30) adjacent said path, actuatably arranging a deflector (12, 27, 38) on each of said gathering pockets, and moving a deflector (13, 27, 38) to intercept a sheet-like material article lead edge portion as the sheet-like material article moves in said shingled formation to deflect the leading edge into a gathering pocket.

19. A method for gathering sheet-like material articles according to claim 18, wherein a respective deflector (13, 27, 28) moves a respective lead edge portion (4.1) due to the lapped distance between sheet material articles (4) in said shingled formation (30).

* * * * *